United States Patent [19]

Sturtz, Jr.

[11] 4,211,256

[45] Jul. 8, 1980

[54] CIRCULATING FLOW HYDRAULIC PILOT SYSTEM

[75] Inventor: Charles R. Sturtz, Jr., St. Joseph, Mich.

[73] Assignee: Clark Equipment Company, Buchanan, Mich.

[21] Appl. No.: 860,360

[22] Filed: Dec. 14, 1977

[51] Int. Cl.[2] ..... F15B 13/043

[52] U.S. Cl. ..... 137/625.64; 91/48; 91/51; 91/52; 137/625.6; 251/26

[58] Field of Search ..... 91/48, 51, 52; 137/625.6, 625.64; 251/26

[56] References Cited

U.S. PATENT DOCUMENTS

| | | | |
|---|---|---|---|
| 2,729,242 | 1/1956 | Olson | 91/51 X |
| 3,304,953 | 2/1967 | Wickline et al. | 137/625.6 X |
| 3,434,390 | 3/1969 | Weiss | 91/51 |
| 3,537,355 | 11/1970 | Bliss | 91/51 |
| 3,964,518 | 6/1976 | Hesse et al. | 137/625.64 |
| 4,014,509 | 3/1977 | Yoshino et al. | 137/625.64 X |

FOREIGN PATENT DOCUMENTS

| | | | |
|---|---|---|---|
| 2555495 | 6/1977 | Fed. Rep. of Germany | 137/625.6 |
| 19056 | 8/1969 | Japan | 137/625.6 |

*Primary Examiner*—Gerald A. Michalsky
*Attorney, Agent, or Firm*—Harry G. Thibault

[57] ABSTRACT

A circulating flow hydraulic pilot system supplies pressurized fluid from a source to a sump through first and second parallel disposed conduits. Selective pressurization of each conduit is achieved by a pilot valve and a fluid restrictor that are series interposed into each conduit. A fluid actuator includes two ports that communicate with respective ones of the conduits intermediate of respective ones of the pilot valves and fluid restrictors. Other pilot valves are provided for manually overriding the pilot system.

11 Claims, 3 Drawing Figures

CIRCULATING FLOW HYDRAULIC PILOT SYSTEM

BACKGROUND OF THE INVENTION

1. Field of the Invention

The present invention relates generally to hydraulic pilot systems, and more particularly to a pilot hydraulic system in which pilot fluid circulates from a source of pressurized fluid, to the actuator ports of a fluid actuator, and on to a sump.

2. Description of the Prior Art

Prior art hydraulic pilot systems have conventionally supplied pressurized fluid to one port of a fluid actuator through a conduit and have then received fluid back from that one port through the same conduit. This type of pilot system functions satisfactorily in environments where the ambient temperatures are moderate; but, when subjected to very low temperatures, the fluid that is in the conduit becomes and remains quite viscous, resulting in sluggish operation, because the fluid in the conduit is not recirculated with the source fluid, and so the fluid in the conduit never reaches a normal operating temperature.

In particular, a conventional hydraulic pilot system is quite inadequate for use with tree harvesters that operate in the northern part of the United States and in Canada. Tree harvesters, such as are disclosed in U.S. Pat. No. 3,905,407, use hydraulic cylinders to hold or grapple, to fell or shear, to lift and position, to delimb, to top, to bunk, and to drop processed trees in bundles. To speed processing, it is highly advantageous to automate the processing cycle. Also, it is highly advantageous to provide logic which will top the tree in accordance with the tree size. A hydraulic pilot system is well suited to these automation and logic functions, providing that it can be made to operate satisfactorily in cold climates.

SUMMARY OF THE INVENTION

In accordance with the broader aspects of this invention, there is provided a hydraulic pilot system which includes a source of pressurized fluid having a pump, a sump for receiving fluid, a first conduit supplying fluid from the source to the sump, a second conduit supplying fluid from the source to the sump, a first fluid restrictor and a first pilot valve being series interposed into the first conduit, a second fluid restrictor and a second pilot valve being series interposed into the second conduit, and a fluid actuator or valve actuator having first and second ports that are communicated to respective ones of the fluid conduits intermediate of respective ones of the fluid restrictors and the pilot valves.

In a preferred embodiment, the first and second conduits and the first and second fluid restrictors are sized to provide equal viscous fluid resistances from the source to the sump so that the rates of fluid flow through the conduits are substantially equal under all operating temperatures and resultant fluid viscosities; and the ports of the fluid actuator communicate with respective ones of the conduits at equidistant points from the sump so that substantially equal fluid pressures will exist in both of the actuator ports irrespective of fluid operating temperatures and resultant fluid viscosities, precluding actuation of the valve actuator by back pressures.

In one embodiment, the pilot valves are intermediate of the source and the communications of the actuator ports, so that an unbalanced pressure condition on the two ports is achieved when an actuator port is depressurized by moving the respective pilot valve to a flow blocking position; whereas, in the preferred embodiment, the pilot valves are intermediate of the sump and the communications of the fluid actuator ports, so that an unbalanced pressure condition in the two ports is achieved when an actuator port is pressurized by moving the respective pilot valve to a flow blocking position. In the discussed embodiments, substantially equal fluid pressures are applied to both actuator ports when both pilot valves are in free-flow positions.

In both of the above-discussed embodiments, the first and second pilot valves, which are normally power actuated as a part of an automatic system, may be overridden by a third pilot valve that reestablishes equal fluid pressures in the conduits. In one embodiment, the reestablishment of equal fluid pressures comprises supplying pressurized fluid from the source to both of the conduits irrespective of the operating positions of the first and second pilot valves. In the preferred embodiment, the reestablishing of equal fluid pressures in the first and second conduits comprises bleeding pressurized fluid from both of the conduits irrespective of the operating positions of the first and second pilot valves.

In both of the discussed embodiments, fourth and fifth pilot valves may be interposed into respective ones of the first and second conduits, intermediate of respective ones of the first and second pilot valves and the first and second actuator ports; so that an unbalance in fluid pressures applied to the actuator ports by an automatic system may be overridden by the third pilot valve, and the fourth and fifth pilot valves may be used to selectively establish a pressure unbalance between the first and second actuator ports.

It is a first object of the present invention to provide a hydraulic pilot system in which pilot fluid flows from a source to actuator ports of a fluid actuator and on to a sump.

It is a second object of the present invention to provide a hydraulic pilot system in which the pilot flow is substantially continuous when the pilot system is in a stand-by condition.

It is a third object of the present invention to provide a hydraulic pilot system in which automatic control of the system may be manually overridden.

It is a fourth object of the present invention to provide a hydraulic pilot system in which the actuator ports may be selectively pressurized irrespective of automatic control of the system.

It is a fifth object of the present invention to provide a hydraulic pilot system in which the conduits have substantially equal viscous fluid resistances from a source to a sump.

It is a sixth object of the present invention to provide a hydraulic pilot system in which the conduits have substantially equal viscous fluid resistances from actuator ports of a fluid actuator to a sump.

These and other advantages and objects of the present invention will be readily apparent by referring to the following detailed description wherein:

DESCRIPTION OF THE PREFERRED EMBODIMENTS

A First Embodiment

Figure 1:
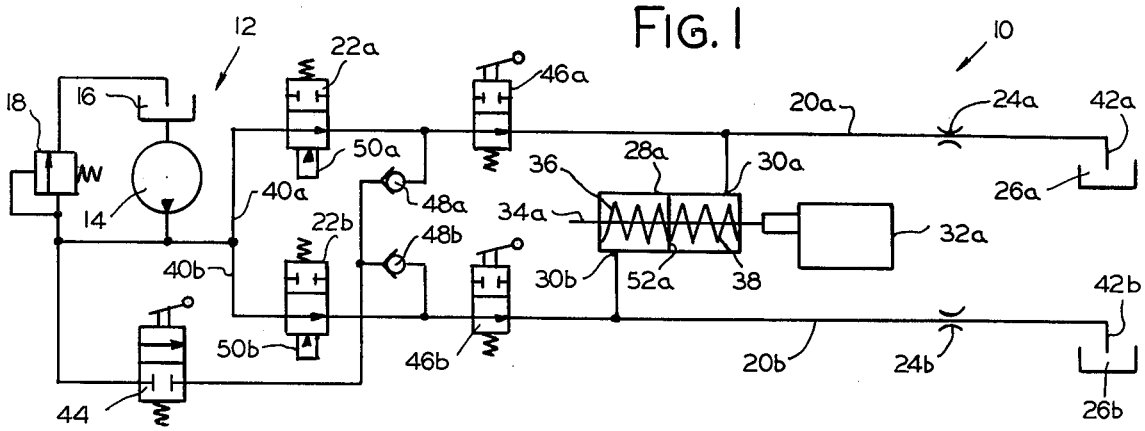
FIG. 1 is a schematic drawing of a first embodiment of the present invention in which the fluid restrictors are intermediate of the actuator ports and the sump.

Referring now to FIG. 1, a circulating flow hydraulic pilot system 10 includes a source of pressurized fluid 12 having a pump 14, a sump 16, a pressure relief valve 18 for limiting the maximum fluid pressure of the source 12, a first conduit 20*a* having a first pilot valve 22*a* and a first fluid restrictor 24*a* interposed in series in the first conduit 20*a*, a second conduit 20*b* having a second pilot valve 22*b* and a second fluid restrictor 24*b* interposed in series in the second conduit 20*b*, sump means which comprises sumps 26*a* and 26*b*, a fluid actuator or valve actuator 28*a* having actuator ports 30*a* and 30*b*, a directional control valve 32*a* having a neutral or stand-by position intermediate of two operating positions and being connected to the valve actuator 28*a* by a piston rod 34*a* of valve actuator 28*a*, and resilient bias means comprising springs 36 and 38 for resiliently urging the directional control valve 32*a* to a neutral or stand-by position thereof. The conduits 20*a* and 20*b* include ends 40*a* and 40*b* which are connected to the pump 14 and ends 42*a* and 42*b* that are operatively connected to respective ones of the sumps 26*a* and 26*b*.

The circulating flow hydraulic pilot system 10 of FIG. 1 optionally includes a third pilot valve 44, a fourth pilot valve 46*a*, a fifth pilot valve 46*b*, a first check valve 48*a*, and a second check valve 48*b*.

In operation, pressurized fluid from the pump 14 of the source 12 flows through the conduits 20*a* and 20*b* to respective ones of the sumps 26*a* and 26*b*, the pilot valves 22*a* and 22*b* being in free-flow positions, as shown, as opposed to flow blocking positions. At this time the fluid conductance of the fluid restrictors 24*a* and 24*b* is much smaller than the fluid conductance of the conduits 20*a* and 20*b* so that the maximum fluid pressure of the source 12, as determined by the pressure relief valve 18, is applied to both of the actuator ports, 30*a* and 30*b*. Thus the fluid pressures which are applied to the actuator ports 30*a* and 30*b* are substantially equal, and the resilient bias means of the springs 36 and 38 is effective to actuate the directional control valve 32 to the neutral or stand-by position thereof.

When the pilot valve 22*a* is actuated to the flow blocking position thereof by release of the power actuator 50*a* thereof, fluid flow from the pump 14 through the conduit 20*a* is blocked, allowing fluid pressure in the actuator port 30*a* to decrease to substantially the value of the fluid pressure in the sump 26*a*; so that fluid pressures in the actuator ports 30*a* and 30*b* are unbalanced and a piston 52*a* of the valve actuator 28*a* moves toward the actuator port 30*a*.

If the pilot valve 22*a* is in the flow blocking position, then manual actuation of the third pilot valve 44 from the flow blocking position shown, to the free-flow position, reestablishes pressure balance on the actuator ports 30*a* and 30*b* by supplying pressurized fluid to the conduits 20*a* and 20*b* from the pump 14 via respective ones of the check valves 48*a* and 48*b*. Then, a selective unbalance in the fluid pressures of the actuator ports 30*a* and 30*b* may be achieved by actuating one of the pilot valves 46*a* or 46*b*.

A SECOND EMBODIMENT

Figure 2:
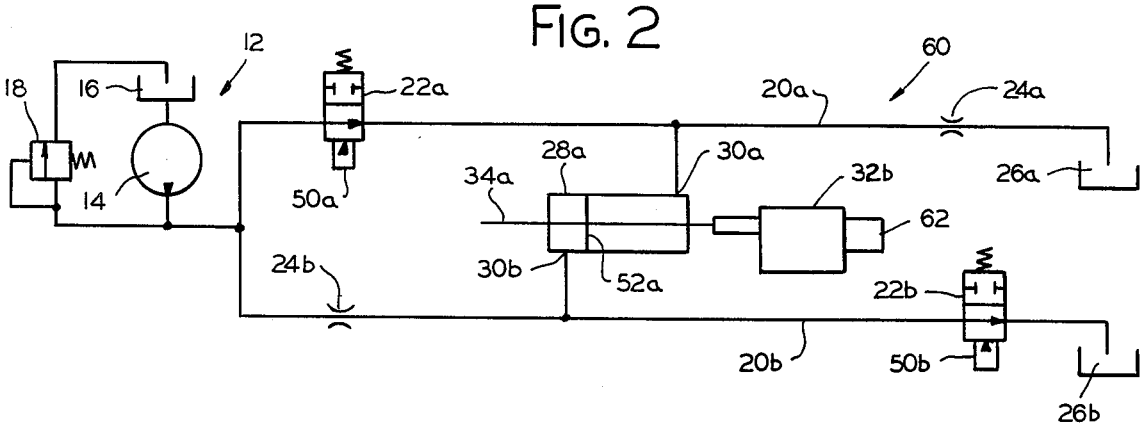
FIG. 2 is a schematic drawing of a second embodiment of the present invention in which one of the fluid restrictors is intermediate of the source and one actuator port, and the other fluid restrictor is intermediate of the other actuator port and the sump.

Referring now to FIG. 2, a circulating flow hydraulic pilot system 60 includes like named and like numbered components so that a detailed recitation of the components is not necessary. The differences between the hydraulic pilot system 60 of FIG. 2 and the hydraulic pilot system 10 of FIG. 1 includes the elimination of the pilot valves 44, 46*a*, and 46*b*, the elimination of the check valves 48*a* and 48*b*, the elimination of the springs 36 and 38 of the resilient bias means, and interchanging of the location of the pilot valve 22*b* and the restrictor 24*b*.

In operation, the pilot valves 22*a* and 22*b* are in the free-flow positions shown when the system is in the stand-by position; so that pilot fluid is circulated from the pump 14 to the sumps 26*a* and 26*b*, providing a warming effect to the fluid. Under these conditions, the fluid pressure in the actuator port 30*a* approximates that of the maximum fluid pressure as determined by the pressure relief valve 18; and the fluid pressure in the actuator port 30*b* approaches that of the fluid pressure in the sump 26*b*. Actuation of the pilot valves 22*a* and 22*b* to the flow blocking positions thereof is effective to reduce the fluid pressure in the actuator port 30*a* to approximately that of the sump 26*a* and to increase the fluid pressure in the actuator port 30*b*, so that the piston rod 34*a* is actuated rightwardly. However, if only the pilot valve 22*a* is actuated to the flow blocking position thereof, the fluid pressure in both of the actuator ports 30*a* and 30*b* approaches that of the sumps 26*a* and 26*b*, and the piston 52*a* is centered between the actuator ports 30*a* and 30*b* by a centering spring mechanism 62, of the directional control valve 32*b*, which optionally replaces the springs 36 and 38 of FIG. 1.

The advantage of the FIG. 2 configuration is that, in a hydraulic pilot system in which the valve actuator must be in a stroked, rather than a centered position, for the neutral or stand-by condition, the configuration of FIG. 2 retains the constant circulation of fluid through the conduits 20*a* ad 20*b* while still achieving the stroked condition of the actuator 28*a*.

A THIRD EMBODIMENT

Figure 3:
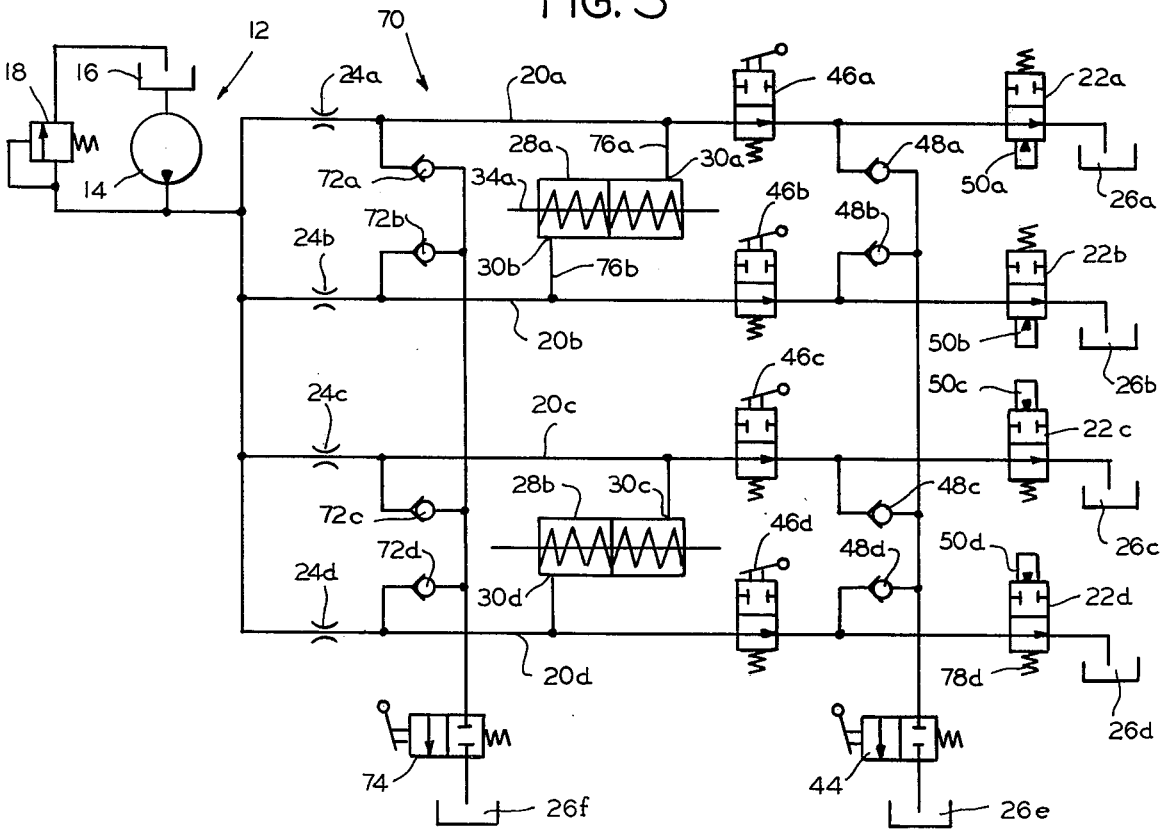
FIG. 3 is a schematic drawing of the present preferred embodiment of the present invention in which the fluid restrictors are intermediate of the source of pressurized fluid and the actuator ports.

Referring now to FIG. 3, a circulating flow hydraulic pilot system 70 includes like named and like numbered parts as have been recited for the hydraulic pilot system 10 of FIG. 1; so that a detailed recitation of the parts is unnecessary. However, the hydraulic pilot system 10 includes additional components for operating a second fluid actuator 28*b*, and a second means for overriding the automatic system which comprises check valves 72*a*, 72*b*, 72*c*, 72*d*, and a pilot valve 74. The primary difference in the hydraulic pilot system 70 from that of the hydraulic pilot system 10 is that the fluid restrictors, such as the fluid restrictor 24*a*, and the pilot valves, such as the pilot valve 22*a*, are interchanged in their positions in the respective ones of the conduits, such as the conduit 20*a*.

In operation, the pump 14 supplies a flow of pilot fluid to the conduits 20*a* and 20*b* through the fluid restrictors 24*a* and 24*b*; and this flow of pilot fluid is discharged to respective ones of the sumps 26*a* and 26*b*, maintaining a fluid pressure in the actuator ports 30*a* and 30*b* that approaches that of the sumps 26*a* and 26*b*. When the pilot valve 22*a* is actuated to the flow blocking position by the power actuator 50*a*, the fluid pressure in the actuator port 30*a* is increased to approximate that of the pump 14.

If the actuator port 30*a* is pressurized by the pilot valve 22*a* being in the flow blocking position, the system 70 may be overridden by actuating the pilot valve 44 to the free-flow position, relieving pressurized fluid in the actuator port 30*a* by fluid flow to a sump 26*e* via the check valve 48*a*. Then, either the actuator port 30*a* or the actuator port 30*b* can be selectively pressurized by manually actuating a respective one of the pilot valves, 46*a* or 46*b*, to the flow blocking position thereof.

Alternately, the check valves 72*a* and 72*b* may be used in conjunction with the pilot valve 74 to override the system 70 by relieving pressurized fluid in the actuator ports 30*a* and 30*b* by fluid flow to a sump 26*f*. However, actuation of the pilot valve 74 results, not only in equalization of fluid pressure to both of the actuator ports, 30*a* and 30*b*, but also in inactivation of the pilot valves 46*a* and 46*b* so that the system can not be manually actuated.

Preferably, in the FIG. 3 embodiment, the conduits 20*a* and 20*b* have equal viscous fluid resistances, and the fluid restrictors 24*a* and 24*b*, have equal fluid resistances so that the rate of fluid flow from the pump 14 to respective ones of the sumps 26*a* and 26*b* are substantially equal irrespective of temperature and resultant viscosity changes in the hydraulic fluid. Also, preferably the fluid resistances of those portions of the conduits 20*a* and 20*b* which are intermediate of the actuator ports 30*a* and 30*b* and respective ones of the sumps 26*a* and 26*b* are substantially equal, so that substantially equal fluid pressures will be applied to the ports 30*a* and 30*b* irrespective of viscosity changes in the hydraulic fluid. Also, preferably the length of any conduits, such as conduits 76*a* and 76*b*, which are intermediate of respective ones of the actuator ports 30*a* and 30*b* and the conduits 20*a* ad 20*b*, does not exceed ten percent of the length of the conduits 20*a* and 20*b*, and desirably does not exceed five percent of the length of the conduits 20*a* and 20*b*; so that effectively, the ports 30*a* and 30*b*, are directly connected to, or communicate with, the conduits 20*a* and 20*b*.

Referring again to FIG. 3, it is apparent that the number of fluid actuators, such as the fluid actuator 28*a*, can be multiplied to any reasonable number by reduplicating the components as previously enumerated and described. In like manner, it is apparent that the embodiments of FIGS. 1, 2, and 3 can be intermixed, using only one source of pressurized fluid 12.

Preferably, the fluid actuators, such as the fluid actuator 28*a* of FIG. 1, are of the type in which a piston rod, such as the piston rod 34*a*, extends outwardly through both ends of the fluid actuator, providing equal actuating areas on opposite sides of the piston, such as the piston 52*a*.

The pilot valves, as characterized by the pilot valve 22*d* of FIG. 3, may be of the type in which a spring, such as the spring 78*d*, actuates the pilot valve to the free-flow position; or the pilot valves, as characterized by the pilot valve 22*a*, may be of the type in which a power actuator, such as the power actuator 50*a*, actuates the pilot valve to the free-flow position. It should be understood that the type of power actuator, whether electrical, pneumatic, hydraulic, or mechanical, is a matter of choice and is not a part of the present invention.

In the best mode contemplated for carrying out this invention, each of the directional control members (not shown) in FIG. 3 attached to respective piston rods of the two fluid or valve actuators includes a centering mechanism of the type illustrated in FIG. 2. Therefore in such best mode the springs shown in the actuators of FIG. 3 may be eliminated.

While the presently preferred configuration is that of the FIG. 3 embodiment, the hydraulic pilot system of FIG. 1 includes the advantage of being less sensitive to viscous fluid pressure losses in the conduits 20*a* and 20*b* than that of the preferred embodiment of FIG. 3. A pending U.S. patent application, Ser. No. 860,359 entitled "Tree Harvester," of common filing date and common assignee, the entire specification of which is included herein by reference thereto, illustrates and describes a particular application of the FIG. 3 embodiment.

While cnly the three embodiments of the present invention have been described in detail, it will be understood that each detailed description is intended to be illustrative only and that various modifications and changes may be made to the present invention without departing from the spirit and scope of it. Therefore the limits of the present invention should be determined from the attached claims.

What is claimed is:

1. A hydraulic system of the type which includes a directional control valve having a stand-by position and an operating position, source means for supplying pressurized fluid, means for limiting the maximum fluid pressure of said source means, sump means for receiving fluid, and a pilot hydraulic system for actuating said directional control valve to said operating position, in which said pilot system comprises:

a first conduit receiving pressurized fluid from said source means and establishing a first fluid flow path to said sump means;

a second conduit receiving pressurized fluid from said source means and establishing a second fluid flow path to said sump means;

first and second fluid restrictors being interposed into respective ones of said first and second fluid flow paths;

first and second pilot valves, each having a free-flow and a flow blocking position, and each being interposed into respective ones of said fluid flow paths in series flow relationship with respective ones of said fluid restrictors;

a fluid actuator, operatively connected to said directional control valve, having a first actuator port that communicates with said first fluid flow path intermediate of said first fluid restrictor and said first pilot valve, and having a second actuator port that communicates with said second fluid flow path intermediate of said second fluid restrictor and said second pilot valve, said actuator ports being subject to substantially equal fluid pressures when said pilot valves are in said free-flow position;

bias means for resiliently urging said directional control valve to said stand-by position;

operating means for moving one of said pilot valves from said free-flow position to said flow blocking position so that unequal fluid pressures are applied to said actuator ports;

override means for reestablishing substantially equal fluid pressures applied to said actuator ports when said one pilot valve is in the blocking position; and means for reapplying unequal fluid pressures to said actuator ports when said override means is in operation.

2. A hydraulic system as claimed in claim 1 wherein said override means includes a third pilot valve.

3. A hydraulic system as claimed in claim 2 wherein said operating means includes providing each of said first and second pilot valves with a power actuator.

4. A hydraulic system as claimed in claim 3 in which said directional control valve includes a second operating position;

said stand-by position is intermediate of said operation positions.

5. A hydraulic system as claimed in claim 4 in which said first and second fluid restrictors have substantially equal fluid resistances irrespective of viscosity changes in said fluid.

6. A hydraulic system as claimed in claim 4 in which said first and second fluid flow paths, including said first and second fluid restrictors thereof, have substantially equal fluid resistances irrespective of viscous changes in said fluid, whereby the rates of fluid flow through said fluid flow paths are substantially equal irrespective of said viscosity changes in said fluid; and said fluid resistances of said first and second fluid flow paths between said communications of said actuator ports and said sump means are substantially equal to each other irrespective of said viscosity changes in said fluid; whereby said equal rates of fluid flow in said flow paths and said substantially equal fluid resistances intermediate of said actuator port communications and said sump means produce substantially equal fluid pressures in said first and second fluid flow paths at said actuator port communications.

7. A hydraulic system claimed in clam 4 in which said interposition of said pilot valves comprises interposing said pilot valves intermediate of respective ones of said fluid restrictors and said sump means.

8. A hydraulic system as claimed in claim 4 wherein said override means includes means for selectively communicating said conduits to said sump means.

9. A hydraulic system as claimed in claim 8 wherein said reapplying means includes means for pressurizing one of said actuator ports by blocking fluid flow from one of said actuator ports to said sump means.

10. A hydraulic system as claimed in claim 9 wherein said pressurizing means includes a fourth pilot valve being interposed into said first conduit intermediate of said first pilot valve and said communication of said first actuator port with said first conduit and a fifth pilot valve being interposed into said second conduit intermediate of said second pilot valve and said communication of said second actuator port with said second conduit.

11. A hydraulic system as claimed in claim 10 wherein said means for selectively communicating said conduits to said sump means includes said third pilot valve and a pair of check valves communicating with said first and said second conduits intermediate of respective ones of said first and fourth and second and fifth pilot valves.

* * * * *